United States Patent [19]

Baird, Jr. et al.

[11] 4,003,823

[45] Jan. 18, 1977

[54] COMBINED DESULFURIZATION AND HYDROCONVERSION WITH ALKALI METAL HYDROXIDES

[75] Inventors: William C. Baird, Jr.; Roby Bearden, Jr., both of Baton Rouge, La.

[73] Assignee: Exxon Research and Engineering Company, Linden, N.J.

[22] Filed: Apr. 28, 1975

[21] Appl. No.: 571,912

[52] U.S. Cl. ..... 208/108; 208/209; 208/230; 208/251 H; 208/264; 208/283; 208/284; 252/439; 252/476

[51] Int. Cl.[2] ..... C10G 13/06; B01J 27/04

[58] Field of Search ..... 208/108–112, 208/208 R, 208 M; 264/209, 226; 283/230, 235

[56] References Cited

UNITED STATES PATENTS

| | | | |
|---|---|---|---|
| 1,729,943 | 10/1929 | Hofsass | 260/667 |
| 3,160,580 | 12/1964 | Aschenbach et al. | 208/226 |
| 3,787,315 | 1/1974 | Bearden et al. | 208/208 M |
| 3,915,844 | 10/1975 | Ueda et al. | 208/127 |

*Primary Examiner*—Herbert Levine
*Assistant Examiner*—G. E. Schmitkons
*Attorney, Agent, or Firm*—Edward M. Corcoran

[57] ABSTRACT

Processes for the simultaneous desulfurization and hydroconversion of heavy carbonaceous feeds, including various sulfur-containing heavy petroleum oils, are disclosed. These feeds are contacted with alkali metal hydroxides in a conversion zone, in the presence of added hydrogen, and at elevated temperatures, whereby the feeds are substantially desulfurized, while at the same time significant upgrading of these feedstocks is obtained as demonstrated by decreased Conradson carbon, increased API gravity, and the conversion of a substantial portion of the 1,050° F+ portion of the feedstream. In addition, methods for the regeneration of alkali metal hydroxides from the alkali metal salts produced in the conversion zone are disclosed.

21 Claims, 1 Drawing Figure

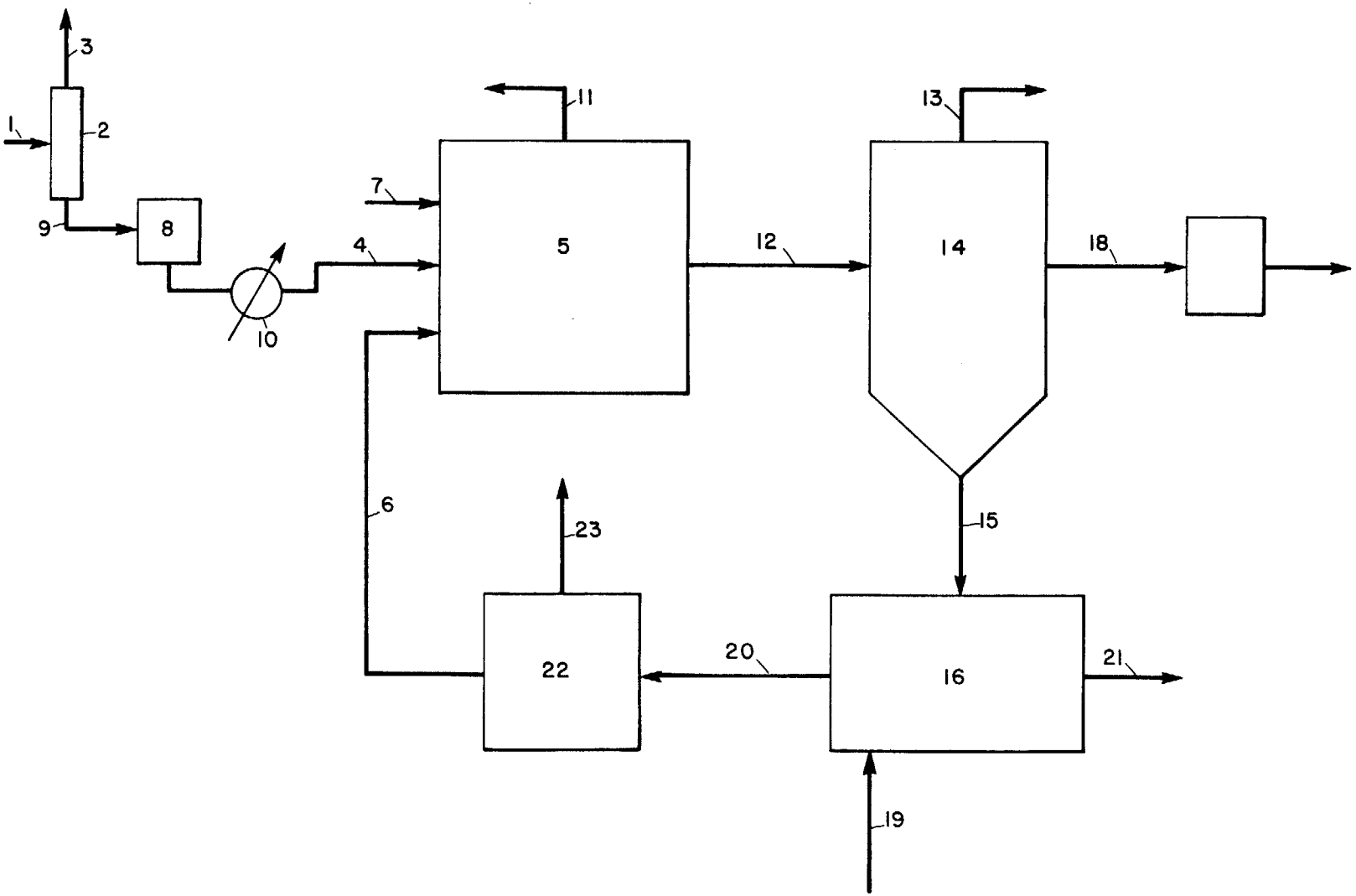
1
2
3
9
8
10
4
7
5
11
6
12
14
13
18
15
16
19
20
22
23
21

COMBINED DESULFURIZATION AND HYDROCONVERSION WITH ALKALI METAL HYDROXIDES

FIELD OF THE INVENTION

The present invention relates to processes for the combined desulfurization and conversion of sulfur-containing hydrocarbon feedstocks. More particularly, the present invention relates to processes for the combined desulfurization and hydroconversion of heavy hydrocarbon feedstocks in the presence of alkali metal hydroxides. Still more particularly, the present invention relates to processes for the combined desulfurization and hydroconversion of sulfur-containing heavy hydrocarbon feedstocks in the presence of a desulfurization agent, wherein the desulfurization agent is regenerated and recycled therein.

DESCRIPTION OF THE PRIOR ART

Because of the large amounts of sulfur-bearing fuel oils which are currently being employed as raw materials in the petroleum refining industry, the problems of air pollution, particularly with regard to sulfur oxide emissions, have become of increasing concern. For this reason, various methods for the removal of sulfur from these feedstocks have been the subject of intensive research efforts by this industry. At present, the most practical means of desulfurizing such fuel oils is the catalytic hydrogenation of sulfur-containing molecules and petroluem hydrocarbon feeds in order to effect the removal, as hydrogen sulfide, of the sulfur-containing molecules. This process generally requires relatively high hydrogen pressures, generally ranging from about 700 to 3,000 psig, and elevated temperatures generally ranging from about 650° to 850° F, depending upon the feedstock employed and the degree of desulfurization required. In such processes there is generally no conversion of the feedstocks employed, such desulfurization processes generally being employed in connection with other conventional petroleum conversion processes.

Such catalytic desulfurization processes are generally quite efficient when particular types of feeds are being processed, but become of increased complexity and expense, and decreasing efficiency, as increasingly heavier feedstocks, such as whole or topped crudes and residua are employed. As an additional complicating factor, such residuum feedstocks often are contaminated with heavy metals, such as nickel, vanadium and iron, as well as with asphaltenes, which tend to deposit on the catalyst and deactivate same. Furthermore, the sulfur in these feeds is generally contained in the higher molecular weight molecules which can only be broken down under the more severe operating conditions, which thus tend to degrade the feedstock due to thermal cracking, with consequent olefin and coke formation, and therefore accelerate catalyst deactivation.

As an alternative desulfurization process, molten dispersions of various alkali metals, such as sodium and alkali metal alloys, such as sodium/lead have been employed as desulfurization agents. Basically, these processes have involved the contacting of a hydrocarbon fraction with such an alkali metal or sodium dispersion, wherein the sodium reacts with the sulfur to form dispersed sodium sulfide ($Na_2S$). Such a process is thus taught in U.S. Pat. No. 1,938,672 which employs such alkali metals in a molten state. These processes, however, have suffered from several distinct disadvantages. Specifically, these have included relatively low desulfurization efficiency, due partially to the formation of substantial amounts of organo-sodium salts, the tendency to form increased concentrations of high molecular weight polymeric components, such as asphaltenes, and the failure to adequately remove metal contaminants from the oil. In addition, it has, in the past, been exceedingly difficult to resolve the resultant alkali metal salts-oil mixtures and regenerate alkali metal therefrom. Furthermore, none of these processes has been useful in effecting the upgrading of the feedstocks employed during their desulfurization, and particularly not without coke formation therein. Recently, however, U.S. Pat. No. 3,788,978 assigned to Exxon Research and Engineering Company, the assignee of the present invention, disclosed a process which included means for resolving the desulfurized oil-alkali metal salt mixtures. Furthermore, U.S. Pat. No. 3,878,315 also assigned to Exxon Research and Engineering Company, disclosed that such alkali metal desulfurization, when carried out in the presence of low pressure hydrogen, resulted in improved efficiency, whereby less sodium was required in order to remove given amounts of sulfur. Furthermore, improved demetallization, and elimination of sludge formation was obtained. Again, however, the simultaneous desulfurization and hydroconversion of the feeds employed is not effected therein.

In an alternative desulfurization process, U.S. pat. No. 2,034,818 discloses oil treatment with nascent hydrogen and hot fixed gases, and specifically employing volatilized metallic sodium for reaction with a water-containing oil feed to produce such nascent hydrogen, and thereby to increase the hydrogenation of the oils. The patantee thus discloses that the action of the metallic sodium with the water in the oil produces sodium hydroxide, and serves as a source of hydrogen in the oil. The patentee thus does not appreciate the value of alkali metal hydroxides as desulfurizing agents, and furthermore employs a water-containing process which is not deemed desirable. Furthermore, he operates outside the range of conditions where any hydroconversion of the feed could possibly be effected.

U.S. Pat. No. 2,950,245 teaches distillation of various petroleum oils with alkali metal hydroxides, among other substances, and including potassium, sodium, and other alkali metal hydroxides. The distillation occurs to an end point of about 800° F, to produce a distillate product and a coke residue. The patantee, however, does not teach contacting, in the presence of hydrogen, in order to both desulfurize and convert such a hydrocarbon feedstream, particularly not with low coke yield.

The search has thus continued for improved desulfurization processes, and particularly for such processes wherein simultaneous hydroconversion of feed can also be realized with low coke make, etc., and for improved methods for carrying out such processes and regenerating the products produced by the contacting of the desulfurization agent and the sulfur-containing feed in the contacting zone.

SUMMARY OF THE INVENTION

In accordance with the present invention, it has now been discovered that various sulfur-containing hydrocarbon feedstocks can be both desulfurized and upgraded by means of hydroconversion in the presence of a desulfurizing agent comprising an alkali metal hydroxide. Heavy hydrocarbon feedstocks, including whole or topped crudes, or various residua, are thus contacted with an alkali metal hydroxide in a conversion zone, in the presence of added hydrogen, the conversion zone being maintained at a pressure of from between about 500 to about 5000 psig, and at a temperature of between about 500 and 2000° F. The reaction products thus comprise a desulfurized, demetallized and highly upgraded hydrocarbon feedstock, exhibiting decreased Conradson carbon, increased API gravity, and in which at least a portion, and preferably a substantial portion, of the 1,050° F+ portion of the feedstream is converted to lower boiling products. Preferably at least about 50% of the sulfur content of the feedstream employed will be removed by the present process, while from between about 50 and 80% of the 1,050° F+ portion of these feeds are converted to lower boiling products. That is, with recycle to extinction, from 10 to 100% of this 1,050° F+ portion will be so converted, and on a once-through basis, from 10 to 80%, but preferably 50 to 80% thereof will be so converted to lower boiling products. In addition, various alkali metal salts, primarily metal sulfides and/or hydrosulfides also are produced therein. Contacting of the alkali metal hydroxide with the sulfur-containing feedstock in the manner described above thus produces a product stream including the alkali metal salts noted therein. In one embodiment of the present invention, the alkali metal salts thus produced are separated from the improved oil product stream, and alkali metal hydroxides are regenerated and recycled therefrom. Preferably, hydrogen sulfide is added to the products removed from the conversion zone, so that any alkali metal sulfides contained therein are converted to corresponding alkali metal hydrosulfides.

The regeneration of alkali metal hydroxides may then be accomplished in several ways, including reacting the alkali metal sulfides or hydrosulfides with steam at high temperatures, as described in British Pat. No. 1176, or oxidizing the alkali metal sulfides or hydrosulfides in the presence of activated carbon, as in German Pat. No. 2,151,465, or in the presence of magnesium dioxide, Zh. Prinkl Khim, 38,1212 (1965).

DETAILED DESCRIPTION

Any feedstock from which sulfur is desired to be removed may, in theory, be used in the present process. Thus, while the process is applicable to distillates, it is particularly effective when employed for the desulfurization of heavy hydrocarbons, for example, those containing residual oils. Preferably, therefore, the process disclosed herein may be employed for the desulfurization and simultaneous hydroconversion of whole or topped crude oils and residua. Crude oils obtained in any area of the world, as for example, Safaniya crudes from the Middle East, Laquinillas crudes from Venezuela, various U.S. crudes, etc., can be desulfurized and subjected to hydroconversion in the present process. In addition, both atmospheric residuum boiling above about 650° F and vacuum residuum boiling above about 1,050° F can be so treated. Preferably, the feedstock employed in the present invention is a sulfur-bearing heavy hydrocarbon oil containing at least about 10% materials boiling above 1,050° F, and most preferably at least about 25% materials boiling above 1,050° F. Specific examples of feedstocks applicable to the present process include tar sands, bitumen, shale oils, heavy gas oils, heavy catalytic cycle oils, coal oils, asphaltenes, and other heavy carbonaceous feeds.

While the feeds may be introduced directly into the conversion zone for combined desulfurization and hydroconversion without pretreatment, it is preferred to desalt the feed in order to prevent sodium chloride contamination of the sodium salts which are produced during processing in the conversion zone. Such desalting is a well-known process in the refining industry, and may generally be carried out by the addition of small amounts of water to the feedstock to dissolve the salts, followed by the use of electrical coalescers. The oil may then be dehydrated by conventional means well known in this industry.

The alkali metal hydroxides which may be employed for the present process generally include the hydroxides of those metals contained in Group IA of the Periodic Table of the Elements. Specifically, it has been found that the hydroxides of lithium, sodium, potassium, rubidium and cesium are particularly useful in this process. In addition, combinations of two or more alkali metal hydroxides may be employed. This is particularly useful under the preferred process conditions described below, where binary and/or ternary mixtures of such alkali metal hydroxides providing low melting eutectics may be employed, in order to lower the temperature required for feeding these materials into the conversion zone in the molten state. The most highly preferred hydroxide is that of potassium. Overall, however, the hydroxides of sodium, lithium and potassium are preferred due to their availability and ease of recovery and regeneration, and most preferably potassium hydroxide has been found to be particularly effective in this process. In addition, commercially available hydroxides may be employed, even those containing water and other inorganic impurities, since up to about 15 weight percent water based on the alkali metal hydroxide may be tolerated without the promotion of undesired side reactions. As for the form of the alkali metal hydroxides employed, they may be charged directly to the conversion zone in either pellet, stick or powdered form, or they may be fed thereinto as a dispersion in the hydrocarbon feed itself. While the alkali metal hydroxide may thus be employed in such granular forms ranging from powders of microns or more to particles of from 10 to 35 mesh, the powder is preferred in order that the reaction rate is maximized while the need for mechanical agitation is minimized. The total amount of alkali metal hydroxide employed will depend upon the sulfur content of the feed and the degree of desulfurization and hydroconversion which is desired. Normally, however, the alkali metal hydroxide will be charged to the conversion zone in an amount ranging from between about 1 to 20 weight percent based on the total feed, and preferably between about 5 and 15 weight percent thereof.

While contacting of the alkali metal hydroxide with the sulfur-containing feedstock of this invention is preferably carried out at reaction conditions which are designed to maintain the bulk of the reactions within the conversion zone in the liquid phase, such conditions may be varied to provide for vapor phase contact. The actual conditions of temperature and pressure maintained with the conversion zone are critical to the present invention, and to the combined desulfurization and hydroconversions which is obtainable in this process. In addition, at these conditions the alkali metal hydroxide will generally be in the molten state, and may thus be either sprayed or injected directly into the conversion zone or blended with the feed as a liquid-liquid dispersion, providing the feed temperature is sufficiently high.

Specifically, temperatures of at least about 500° F are employed in the conversion zone, generally from between about 700° and 1500° F, and preferably between about 750° and 1,000° F. Furthermore, hydrogen is fed into the conversion zone in an amount sufficient to maintain hydrogen pressures therein generally ranging from about 500 to 5,000 psig, and preferably between about 1,500 and 3,000 psig. It has thus been found that operation of the conversion zone outside of these ranges does not yield the highly desirable simultaneous hydroconversion, desulfurization and demetallization of this invention. In addition, in the absence of the hydrogen required herein, severe cracking and coking of the feed occurs. As for the temperatures employed herein, at temperatures below the ranges described, the highly desirable hydroconversion does not result, while at temperatures above those described, excessive coking, will occur.

As for the hydrogen required in this process, it can be introduced into the conversion zone either as pure hydrogen, as an example that from a steam reforming process, or as diluted hydrogen gas streams such as discarded refinery streams produced in hydrotreating processes, etc. The overall hydrogen pressures maintained within the conversion zone will generally range from between 500 and 5000 psig, and preferably between about 1500 and 3000 psig.

Contacting in the conversion zone to effect simultaneous desulfurization and hydroconversion may be conducted as either a batch or continuous operation, but continuous operation is obviously preferable. In addition, the staged treating of the feed with successive additions of fresh reagent may be employed. In addition, however, while the sulfur content of the feeds employed in these processes will be reduced in this initial combined desulfurization and hydroconversion step, it still may be that additional sulfur reduction and/or upgrading, including a decrease in Conradson carbon, etc., will be desired in order to prepare a final product stream. This additional upgrading may be achieved by a variety of conventional refining processes, each of which will now be capable of increased efficiency in view of the low metals content, and reduced sulfur and asphaltene level in the second stage feed thereto. Such additional processes may thus include catalytic hydrodesulfurization, hydrocracking, catalytic cracking, etc.

These conventional processes utilize hydrotreating catalysts and cracking catalysts typical of current refinery operations. Process units and operating conditions may, however, be modified from those presently in use in order to take advantage of the process efficiences afforded by these upgraded streams. The nature of these process alterations, which will be obvious to those skilled in this art, will involve conditions of temperature and pressure, reactor size, catalyst loading, space velocity, catalyst regeneration frequency, etc.

The actual apparatus employed in this process is quite conventional in nature, generally comprising a single or multiple reactors equipped with shed rows or other stationary devices to encourage contacting, and other such means, as described in U.S. Pat. No. 3,787,315 at column 5, lines 9 ad seq., which is hereby incorporated herein by reference thereto. As is also described therein, the actual contacting of feedstock and alkali metal hydroxide can be done in either a concurrent, crosscurrent, or countercurrent flow. It is preferable that oxygen and water be excluded from the reaction zones, and therefore the reaction system is thoroughly purged with dry nitrogen and the feedback rendered dry prior to its introduction into the reactor.

The resulting oil dispersion is removed from the conversion zone, and may then be treated by other processes, or resolved so that alkali metal hydroxide is regenerated and recycled for further use.

As a result of the contacting of sulfur-bearing hydrocarbon feedstocks and alkali metal hydroxides under the conditions described above, the alkali metal hydroxides are converted into the corresponding sulfides. If, however, hydrogen sulfide is added to those products withdrawn from the conversion zone, in order to facilitate salt recovery, the alkali metal sulfide is then transformed into the corresponding hydrosulfide. The latter step is preferably carried out such that hydrogen sulfide is added to the product derived from the conversion zone in the following amounts; 110–400 mole % based on alkali metal, preferably 120–160 mole %.

The alkali metal sulfides and/or hydrosulfides thus withdrawn from the conversion zone are initially separated from the reaction product by conventional means. Thus, if these salts are maintained in a liquid state, they will form a separate liquid layer from which the treated oil may be easily separated in a liquid-liquid separator. If, on the other hand, these salts are permitted to settle at reaction conditions and are subsequently cooled, the oil may be separated therefrom by simple withdrawal, decantation, centrifugation, or othe such mechanical means. In both of these cases, any coke formed during the reaction is also scavenged, as are any metals released by the destruction of any asphaltenes in the conversion zone.

The alkali metal salts thus separated from the reaction products may then be used to regenerate alkali metal hydroxides for recycling back to the conversion zone. Three specific examples of such regeneration are described herein, including reaction with steam at high temperature, oxidation in the presence of activated carbon, and oxidation in the presence of magnesium dioxide, as described in detail in the previously cited references.

DESCRIPTION OF THE DRAWINGS

The drawing is a schematic flow diagram of a combined desulfurization and hydroconversion process according to the present invention, including regeneration.

Referring to the drawing, in which like numerals refer to like portions thereof, there is shown an integrated process for treating a sulfur-bearing hydrocarbon feedstock with an alkali metal hydroxide to obtain both desulfurization and hydroconversion, and one method for the regeneration and recycling of alkali metal hydroxide from the products thereof. Referring to the drawing, a sulfur-bearing hydrocarbon feedstock, preferably pre-heated to between about 200° and 500° F, is fed through line 1 into a separator vessel 2 wherein trace amounts of water and light hydrocarbon fractions may be removed though line 3. The feedstocks may then be passed though line 4, including heat exchanger 10, into reactor 5. The feed may, however, prior to entry into reactor 5, be pumped into a filter vessel 8, through line 9 for removal of particulate matter, such as coke, scale, etc., and/or be preliminarily desalted by conventional means which are not shown.

The mixing of alkali metal hydroxide and the pretreated sulfur-bearing hydrocarbon feedstock, may include either means for dispersing the alkali metal hydroxide for intimate contact with the oil feed prior to entry of the dispersion into reactor 5, or as shown, may be by direct injection of spraying of the alkali metal hydroxide, through line 6, into reactor 5, in the molten state. As an alternative, however, a small portion of the feed may be withdrawn and, following pre-heating, initimately contacted with the alkali metal hydroxide in a conventional dispersator vessel operated at between about 250° and 500° F and at atmospheric pressure, and blanketed with hydrogen. The resultant dispersion may then be blended with the balance of the feedstock prior to pressurization for entry into the reaction vessel 5. Thus, for various whole crudes and distillates the minimum pressure will be raised to about 500 psig, and for the residua to about 100 psig. Where the feedstock is a whole crude it will generally have between about 1 and 3 weight percent sulfur therein, and when a residual feedstock, from about 2 to about 7 weight percent sulfur therein, based upon the total feedstream. Following pre-heating, the feed is then fed into reactor 5. The reactor itself may include baffles to promote the continuous contacting of the alkali metal hydroxide and the oil, and to prevent bypassing directly from the inlet of the reactor to the outlet, all of which is conventional. Hydrogen enters the reaction vessel 5 through line 7 in amounts such that the total partial pressure of hydrogen in the reactor is from about 1500 to 3000 psig. Holding times in the reactor of between about 10 and 120 minutes, and preferably above about 30 minutes are employed, and temperature conditions of 750° to 850° F are maintained therein. The temperature at the top of reactor 5 will therefore be about 850° F. Any gases formed within the reactor 5 may be withdrawn overhead through line 11, for condensation and depressurization by conventional means. The desulfurized and hydroconverted products, containing dispersed alkali metal sulfides, may then be withdrawn from reactor 5 through line 12. This dispersion will thus be at a temperature above about 800° F, and at between about 1000 and 1500 psig, and may be subsequently cooled in a heat exchanger prior to separation of the sulfur-bearing salts.

Separation of the alkali metal sulfides and the hydrocarbon product stream is then conducted in a separator vessel 14 of conventional design, generally maintained at between about 700° and 800° F, preferably from 700° to 750° F, and at pressures of from 50 to 1000 psig, preferably from 50 to 500 psig, so that the alkali metal sulfides are precipitated and removed through the bottom thereof through line 15. Hydrocyclone vessels, such as those shown in U.S. Pat. No. 3,878,315 (see column 12, lines 15 through 24, which is incorporated herein by reference thereto) may be employed. The improved hydrocarbon product stream, having been desulfurized and subjected to hydroconversion in reactor 5, is thus removed from separator 14 through line 18. This product may then be subjected to further conventionl processing, such as after contacting with acid to effect the precipitation of oil-soluble alkali metal salts, e.g., alkali metal mercaptides and the like, or employed in any other desired manner. Light hydrocarbon products and hydrogen are removed from separator vessel 14 through line 13. Hydrogen is separated and recycled to the reactor, and light hydrocarbons are directed to product storage.

Additional conventional details of this handling of the products from reactor 5 may be gleaned from the disclosure of U.S. Pat. No. 3,791,966, beginning at column 7 thereof, which is also incorporated herein by reference thereto.

Various methods for the regeneration of alkali metal hydroxides from these alkali metal salts may be employed, as discussed above. The process shown in the drawing includes the contacting of the alkali metal salts withdrawn through line 15 in a regenerator 16, maintained at temperatures of between about 600° and 1500° F, preferably about 1200° F, and atmospheric pressure wherein the alkali metal salts are contacted with stream injected through line 19.

As a result of this regeneration, alkali metal hydroxides are formed in regenerator 16, and withdrawn through line 20, while sulfur, in the form of hydrogen sulfide, is withdrawn from regenerator 16 through line 21. This hydrogen sulfide is directed to a Claus plant for disposal as elemental sulfur. The alkali metal hydroxides withdrawn from regenerator 16 through line 20 are then dried in dryer 22, maintained at temperatures of between about 200° and 800° F, wherein dried alkali metal hydroxide is produced, for recycling through line 6 back into reactor 5. Steam and hydrogen sulfide are removed through line 23 and combined with hydrogensulfide-steam exiting vessel 16 through line 21.

PREFERRED EMBODIMENTS

The present process may be further understood by reference to the following examples thereof.

EXAMPLE 1

The combined desulfurization, hydroconversion, and demetallization of a Safaniya atmospheric residuum feedstock as shown in Table I was carried out employing various alkali metal hydroxides. The results obtained, and the process conditions employed, are contained in Tables II and III hereof.

These results clearly demonstrate the effectiveness of such alkali metal hydroxides not only for the deep desulfurization of the sulfur-containing feedstocks employed, but also for the hydroconversion and demetallization of same. Thus, Conradson carbon reductions of between about 50 and 85 weight percent were obtained when employing the alkali metal hydroxides of this invention, at the particular temperature and hydrogen pressure conditions required. As can be seen from Runs 1 through 6, operation at temperatures below those required and/or under low pressure hydrogen, or no hydrogen added at all, gives minimum sulfur and metals removal, and Conradson carbon reduction, as well as high coke yields. Comparison with Run 9 thus demonstrates the improvement under hydroconversion conditions of sodium hydroxide performance in this regard. Even more strikingly, operation with potassium hydroxide, a highly preferred alkali metal hydroxide, demonstrates markedly improved results in this regard (compare Table II, Runs 4–6 with Table III). The use of a eutectic mixture of hydroxides is demonstrated in Run No. 7. Run 8 shows that the addition of 20% water had a suppressing effect on the activity of sodium hydroxide. Further attention is directed to Table III, wherein commercial potassium hydroxide containing 15% water was employed. Comparison with Run 8 in this regard is significant. Run No. 10 illustrates cesium hydroxide hydroconversion.

Table III shows the facile response of a variety of heavy feeds to potassium hydroxide hydroconversion.

In Table IV the effect of potassium hydroxide charge size in the hydroconversion reaction is demonstrated. Optimum results in terms of product yield and improvement are realized in the range of from 5 to 15 weight percent reagent on feed. Table V illustrates that staged treating is highly effective in maximizing both reagent utilization, yield pattern, and product quality. Table VI, Runs No. 1 and 2 show no activity difference between commercial potassium hydroxide (15 weight percent water) and anhydrous material, and Runs No. 3 and 4 show that addition of water to commercial potassium hydroxide to give 6 weight percent water depresses activity somewhat, although the effect is not really as severe as with sodium hydroxide.

Overall, these results demonstrate the realization of improved hydroconversion, as signified by Conradson carbon losses of between about 50 and 85 weight percent, asphaltene content reductions of between about 80 and 95 weight percent, and most significantly, the conversion of between about 50 and 85 weight percent of the 1,050° F+ fraction of the sulfur-containing feeds employed to lower boiling materials, with minimum coke and $C_5$-gas yields. Hydrogen consumption normally ranges from 500 to 1200 SCF.

Further attention is directed to the significant degrees of demetallization which were also obtained while both the desulfurization and hydroconversion shown above were being realized. Thus, the degrees of demetallization ranging from between about 90 and 100 weight percent may thus be realized.

TABLE I

FEEDSTOCK INSPECTION OF SAFANIYA ATMOSPHERIC RESIDUUM EMPLOYED IN EXAMPLE 1

| | |
|---|---|
| API Gravity | 14.4 |
| Sulfur, Wt. % | 3.91 |
| Nitrogen, Wt. % | 0.26 |
| Carbon, Wt. % | 84.42 |
| Hydrogen, Wt. % | 11.14 |
| Oxygen, Wt. % | 0.27 |
| Conradson Carbon, Wt. % | 11.8 |
| Ash, Wt. % | — |
| Water, Karl Fisher, Wt. % | — |
| Metals, ppm | |
| Ni | 20 |
| V | 77 |
| Fe | 4 |
| Viscosity | |
| VSF 122° F. | 235 |
| 140° F. | 131 |
| 210° F. | — |
| Pour Point, ° F | 33 |
| Naphtha Insolubles, Wt. % | 7 |
| Distillation | |
| IBP, ° F | 464 |
| 5% | 569 |
| 10% | 632 |
| 20% | 724 |
| 30% | 806 |
| 40% | 883 |
| 50% | 962 |
| 60% | 1037 |
| 70% | |
| 80% | |
| 90% | |
| 95% | |
| FBP | 1035 |
| % Rec. | 59.2 |
| % Res. | 40.8 |

TABLE II

DESULFURIZATION AND HYDROCONVERSION OF RESIDUA WITH ALKALI METAL HYDROXIDES

| Run No. 1 | 1 | 2 | 3 | 4 | 5 | 6 | 7 | 8 | 9 | 10 |
|---|---|---|---|---|---|---|---|---|---|---|
| Reagent (wt. % on feed) | NaOH(5) | NaOH(5) | NaOH(5) | KOH(14) | KOH(14) | KOH(14) | NaOH(6) | NaOH(1-0) | NaOH | CiOH |
| Reaction Conditions | | | | | | | $H_2O$ (6) | $H_2O$(2) | (10) | (14) |
| $H_2$, psig | 200 | 500 | 500 | 0 | 0 | 1,000 | 1,800 | 1,700 | 1,800 | 1,800 |
| Temp., ° F | 700 | 700 | 700 | 820 | 680 | 820 | 820 | 820 | 820 | 820 |
| Time, hr. | 0.5 | 0.5 | 1 | 0.5 | 1 | 1 | 1 | 1 | 1 | 35 min. |
| Product Inspections | | | | | | | | | | |
| Sulfur, wt. % | 3.7 | 3.7 | 3.5 | 3.1 | 3.0 | 1.5 | 1.7 | 2.2 | 2.2 | 1.7 |
| Con. Carbon wt. % | 11.5 | 11.1 | 15.0 | 9.1 | 9.6 | 5.4 | 5.8 | 6.8 | 5.3 | 5.8 |
| Ni/V/Fe, ppm | 23/57/7 | 30/43/4 | 24/50/4 | 2/0/2 | 25/12/1 | 2/0/2 | 8/0/2 | 6/1/0 | 6/0/2 | 4/10/0 |
| API gravity | 16.0 | 16.3 | 16.9 | 17.6 | 14.8 | 21.6 | 19.1 | 21.6 | 23.8 | 23.6 |
| Asphaltenes, wt. % | — | — | — | 2.4 | 5.1 | — | — | 2.3 | — | 4.3 |
| Desulfurization % | 4.9 | 5.4 | 10.7 | 21.7 | 24.3 | 61.6 | 56.5 | 43.2 | 44.6 | 52.1 |
| Con. Carbon loss % | 5.0 | 8.3 | — | 24.8 | 20.7 | 51.2 | 52.1 | 43.8 | 56.6 | 37.0 |
| Demetallization % | 21.8 | 30.0 | 29.1 | 96.0 | 52.5 | 94.1 | 90.0 | 93.1 | 92.1 | 84.6 |
| $C/C_4$ gas wt. % | — | — | — | 8.2 | 0.7 | 1.8 | 8.2 | 10.7 | 7.3 | 1.9 |
| Coke wt. % | — | — | — | 7.5 | 1.1 | 5.7 | 1.7 | 5.7 | 4.3 | 0.8 |

TABLE III

DESULFURIZATION AND HYDROCONVERSION WITH POTASSIUM HYDROXIDE

Reaction Conditions: Batch Runs, at 820° F., for 1 Hr., at 1700–1800 Psig $H_2$

| Feed | Safaniya Atm. Residuum | | Safaniya Vacuum Residuum | | GCOS Bitumen | | Jobo Crude | |
|---|---|---|---|---|---|---|---|---|
| KOH wt. % on Feed | 13.9 | | 14.0 | | 15.6 | | 13.2 | |
| K/S Mole Ratio | 1.7 | | 1.3 | | 1.7 | | 1.7 | |
| $C_5^-$ Gas, Wt. % | 4.5 | | 2.1 | | 2.2 | | 0.7 | |
| Coke, Wt. % | 2.4 | | 3.6 | | 1.2 | | 1.1 | |
| Inspections | Feed | Product | Feed | Product | Feed | Product | Feed | Product |
| Sulfur, Wt. % | 3.9 | 1.3 | 5.2 | 1.6 | 4.5 | 1.1 | 3.8 | 1.0 |
| Conradson Carbon wt. % | 12.1 | 5.0 | 23.7 | 10.3 | 12.3 | 5.0 | 13.8 | 5.3 |
| Ni/V/Fe, ppm | 20/77/4 | 3/0/4 | 53/171/28 | 13/3/0 | 78/148/416 | 9/1/0 | 97/459/- | 25/4/1 |
| Asphaltenes, Wt. % | 17.0 | 1.8 | — | 9.7 | — | 3.6 | — | 4.3 |

TABLE III-continued

DESULFURIZATION AND HYDROCONVERSION WITH POTASSIUM HYDROXIDE
Reaction Conditions: Batch Runs, at 820° F., for 1 Hr., at 1700–1800 Psig $H_2$

| | | | | | | | | |
|---|---|---|---|---|---|---|---|---|
| API Gravity | 14.4 | 27.7 | 4.6 | 24.1 | 10.3 | 28.9 | 8.5 | 21.9 |
| 1050° F⁻., Vol. % | 59 | 90 | 0 | 77 | 58 | — | 52 | — |
| Desulfurization, % | | 69 | | 71 | | 77 | | 74 |
| Con. Carbon Loss, % | | 62 | | 59 | | 61 | | 62 |
| Demetallization, % | | 94 | | 94 | | 97 | | 95 |
| 1050° F. + Conversion, % | | 75 | | 77 | | — | | — |

TABLE IV

POTASSIUM HYDROXIDE DESULFURIZATION AND HYDROCONVERSION AS A FUNCTION OF CHARGE SIZE
Reaction Conditions: Batch Runs, at 820° F., for 1 Hr., at 1700–1800 Psig $H_2$

| Feed | Safaniya Atmospheric Residuum | | | | | Safaniya Vacuum Residuum | | |
|---|---|---|---|---|---|---|---|---|
| KOH, Wt. % on Feed | | 13.9 | 32.9 | 8.2 | 1.0 | | 14.0 | 42.8 |
| K/S Mole Ratio | | 1.7 | 4.1 | 1.0 | 0.1 | | 1.3 | 5.3 |
| $C_5^-$ Gas, Wt. % | | 4.5 | 2.9 | 1.8 | — | | 2.1 | 2.3 |
| Coke, Wt. % | | 2.4 | 1.9 | 2.5 | 6.4 | | 3.6 | 4.0 |
| Inspections | (Feed) | | | | | (Feed) | | |
| Sulfur, Wt. % | 3.9 | 1.3 | 0.8 | 1.7 | 2.7 | 5.2 | 1.6 | 0.7 |
| Con. Carbon, Wt. % | 12.1 | 5.0 | 3.3 | 6.5 | 7.5 | 23.7 | 10.3 | 6.2 |
| Ni/V/Fe, ppm | 20/77/4 | 3/0/4 | 0/0/0 | 5/1/0 | 3/13/0 | 53/171/28 | 13/3/0 | 4/0/3 |
| API Gravity | 14.4 | 27.7 | 27.9 | 28.8 | 29.8Z | 4.6 | 24.1 | 25.2 |
| 1050° F.⁻, Vol. % | 59 | 90 | — | — | — | 0 | 77 | 83 |
| Desulfurization, % | | 69 | 81 | 59 | 39 | | 71 | 87 |
| Con. Carbon Loss, % | | 62 | 74 | 49 | 46 | | 59 | 75 |
| Demetallization, % | | 94 | 100 | 94 | 86 | | 94 | 98 |
| 1050° F. + Conversion, % | | 75 | — | — | — | | 77 | 83 |

TABLE V

STAGED POTASSIUM HYDROXIDE DESULFURIZATION AND HYDROCONVERSION

Feed: Safaniya Atmospheric Residuum (as in Table IV)

Reaction Conditions: Batch Runs, at 820° F., and 1700–1800 Psig $H_2$

| Run No. | Base | 1 | 2 | 3 | 4 |
|---|---|---|---|---|---|
| First Stage | | | | | |
| KOH, Wt. % on Feed | 14.0 | 14.0 | 7 | 7 | 14 |
| Time, Hr. | 1 | 2 | 0.5 | 1 | 1 |
| K/S Mole Ratio | 1.7 | 1.7 | 0.85 | 0.85 | 1.7 |
| Second Stage | | | | | |
| KOH, Wt. % on Feed | 0 | 0 | 7 | 7 | 8 |
| Time, Hr. | 0 | 0 | 0.5 | 1 | 1 |
| K/S Mole Ratio | — | — | 0.85 | 0.85 | 1.7 |
| $C_5^-$ Gas, Wt. % | 4.5 | 2.5 | 1.3 | 3.1 | 2.6 |
| Coke, Wt. % | 2.4 | 1.4 | 0.7 | 3.2 | 1.8 |
| API Gravity | 27.7 | 31.9 | 25.0 | 31.2 | 30.3 |
| Desulfurization, % | 69 | 79 | 68 | 85 | 90 |
| Con. Carbon Loss, % | 62 | 71 | 62 | 77 | 85 |
| Demetallization, % | 94 | 97 | 90 | 100 | 92 |
| Efficiency, % | 81 | 93 | 81 | 100 | 66 |

TABLE VI

INFLUENCE OF WATER ON POTASSIUM HYDROXIDE DESULFURIZATION AND HYDROCONVERSION

Feed: Safaniya Atmospheric Residuum (as in Table IV)

Reaction Conditions: Batch Runs, at 820° F., for 1 Hr. at 1700–1800 Psig $H_2$

| Run No. | 1 | 2 | 3 | 4 |
|---|---|---|---|---|
| KOH, Wt. % on Feed | 8.2 | 8.2 | 14.0 | 14.0 |
| KOH, Wt. % | 7.0 | 7.0 | 11.9 | 11.9 |
| $H_2O$, Wt. % | 1.2 | 0 | 2.1 | 2.1 |
| $H_2O$ Added, Wt. % on Feed | 0 | 0 | 0 | 5.0 |
| Total $H_2O$, Wt. % on Feed | 1.2 | 0 | 2.1 | 7.1 |
| K/S Mole Ratio | 1.0 | 1.0 | 1.7 | 1.7 |
| K/$H_2O$ Mole Ratio | 1.8 | — | 1.8 | 0.5 |
| $C_5^-$ Gas, Wt. % | 1.8 | 1.6 | 2.5 | 2.2 |
| Coke, Wt. % | 2.5 | 1.5 | 2.4 | 1.5 |

TABLE VI-continued

INFLUENCE OF WATER ON POTASSIUM HYDROXIDE DESULFURIZATION AND HYDROCONVERSION

Feed: Safaniya Atmospheric Residuum (as in Table IV)

Reaction Conditions: Batch Runs, at 820° F., for 1 Hr. at 1700–1800 Psig $H_2$

| Run No. | 1 | 2 | 3 | 4 |
|---|---|---|---|---|
| Desulfurization, % | 59 | 61 | 69 | 57 |
| Con. Carbon Loss, % | 49 | 50 | 62 | 40 |
| Demetallization, % | 94 | 92 | 94 | 81 |

What is claimed is:

1. A process for the simultaneous desulfurization and hydroconversion of a sulfur-containing hydrocarbon feedstock containing at least 10 wt.% of materials boiling above about 1,050° F, which comprises contacting said hydrocarbon feedstock, substantially in a liquid state, with an alkali metal hydroxide in a conversion zone, in the presence of added hydrogen, said conversion zone being maintained at elevated temperatures ranging between 500°–1,500° F, whereby the sulfur and metals content of said hydrocarbon feedstock is reduced and wherein at least a portion of the 1,050° F+ fraction of said feedstock is converted to lower boiling products.

2. The process of claim 1 wherein between about 50 and 80% of said 1,050° F+ fraction of said feedstock is converted to lower boiling products.

3. The process of claim 1 wherein said elevated temperatures range from between about 750° and 1000° F.

4. The process of claim 1 wherein said alkali metal hydroxide comprises a hydroxide of a metal selected from the group consisting of sodium, lithium, potassium, rubidium, cesium, and mixtures thereof.

5. The process of claim 1 wherein said alkali metal hydroxide comprises potassium hydroxide.

6. The process of claim 1 wherein said alkali metal hydroxide is present in said conversion zone in a molten state.

7. The process of claim 1 wherein said alkali metal hydroxide is present in said conversion zone in an amount ranging from about 5 to 15 weight percent of said feedstock.

8. The process of claim 1 wherein said hydrocarbon feedstock is maintained in a substantially liquid phase within said conversion zone.

9. The process of claim 1 wherein said hydrogen is maintained in said conversion zone at a pressure of between about 500 and 5000 psig.

10. The process of claim 1 wherein said hydrogen is maintained in said conversion zone at a pressure of between about 1500 and 3000 psig.

11. The process of claim 1 wherein said sulfur content of said feedstock is reduced by at least about 50%.

12. A process for the simultaneous desulfurization and hydroconversion of a sulfur-containing feedstock, said feedstock containing at least 10 wt.% of materials boiling above about 1,050° F, which comprises contacting said hydrocarbon feedstock, substantially in a liquid state, with an alkali metal hydroxide in a conversion zone being maintained at a temperature of between about 700° and 1,500° F, so that at least a portion of said alkali metal hydroxides are converted to alkali metal sulfides in said conversion zone, and whereby the sulfur and metals content of said feedstock is reduced, and furthermore wherein at least a portion of the 1,050° F+ portion of said feedstock is converted to lower boiling materials, withdrawing said desulfurized and hydroconverted feedstock and said alkali metal sulfides from said conversion zone, separating said alkali metal hydroxides and alkali metal sulfides from the products withdrawn from said conversion zone, regenerating said alkali metal hydroxides from said alkali metal sulfides, and recycling said alkali metal hydroxides to said conversion zone.

13. The process of claim 12 wherein said hydrogen maintained in said conversion zone is maintained at a pressure of between about 500 and 5000 psig.

14. The process of claim 12 wherein said alkali metal hydroxides are regenerated by contacting with steam at a temperature between about 600° and 1500° F, and at atmospheric pressure.

15. The process of claim 12 wherein said alkali metal hydroxide comprises potassium hydroxide.

16. The process of claim 12 wherein said selected temperature ranges from between about 750° and 1000° F.

17. The process of claim 15 wherein said alkali metal hydroxide is present in said conversion zone in an amount ranging from between about 5 and 15 weight percent of said feedstock.

18. The process of claim 13 wherein said hydrogen is maintained in said conversion zone at a pressure of between about 1500 and 3000 psig.

19. The process of claim 12 wherein between about 50 and 80% of said 1,050° F+ fraction of said feedstock is converted to lower boiling products.

20. The process of claim 13 wherein the feedstock contains at least about 25 wt.% of materials above 1,050° F.

21. The process of claim 4 wherein the feedstock containing at least about 25 wt.% of materials boiling above 1,050° F.

* * * * *